United States Patent [19]

Jacobs et al.

[11] 4,203,117

[45] May 13, 1980

[54] DUAL BEAM LINE SCANNER FOR PHASED ARRAY APPLICATIONS

[75] Inventors: Harold Jacobs, West Long Branch; Robert E. Horn, Middletown, both of N.J.

[73] Assignee: The United States of America as represented by the Secretary of the Army, Washington, D.C.

[21] Appl. No.: 946,687

[22] Filed: Sep. 28, 1978

[51] Int. Cl.[2] ..... H01Q 3/26

[52] U.S. Cl. ..... 343/701; 343/754; 343/854

[58] Field of Search ..... 343/854, 767, 754, 873, 343/785, 701

[56] References Cited

U.S. PATENT DOCUMENTS

| | | | |
|---|---|---|---|
| 2,921,308 | 1/1960 | Hansen et al. | 343/754 |
| 3,155,975 | 11/1964 | Chatelain | 343/873 |
| 3,959,794 | 5/1976 | Chrepta et al. | 343/754 |
| 3,969,729 | 7/1976 | Nemit | 343/854 |

*Primary Examiner*—David K. Moore

*Attorney, Agent, or Firm*—Nathan Edelberg; Jeremiah G. Murray; Bernard Franz

[57] ABSTRACT

A millimeter wave line scanner is disclosed providing steered fan-shaped beams from opposite faces at substantially equal angles of a semiconductor waveguide, rectangular in cross section, and having a plurality of equally spaced metallic perturbations or strips disposed on one of the two radiating sides or faces. Different angles of scan are selectively obtained by means of at least one distributed longitudinal PIN diode formed on an adjoining side of the semiconductor waveguide having electrical circuit means coupled thereto for controlling the diode's conductivity which acts to change the guide wavelength and accordingly cause a variation in radiation angle of the two equal beams radiating in opposite directions and by means coupling energy of changing frequency to the semiconductor waveguide.

17 Claims, 8 Drawing Figures

FIG. 1
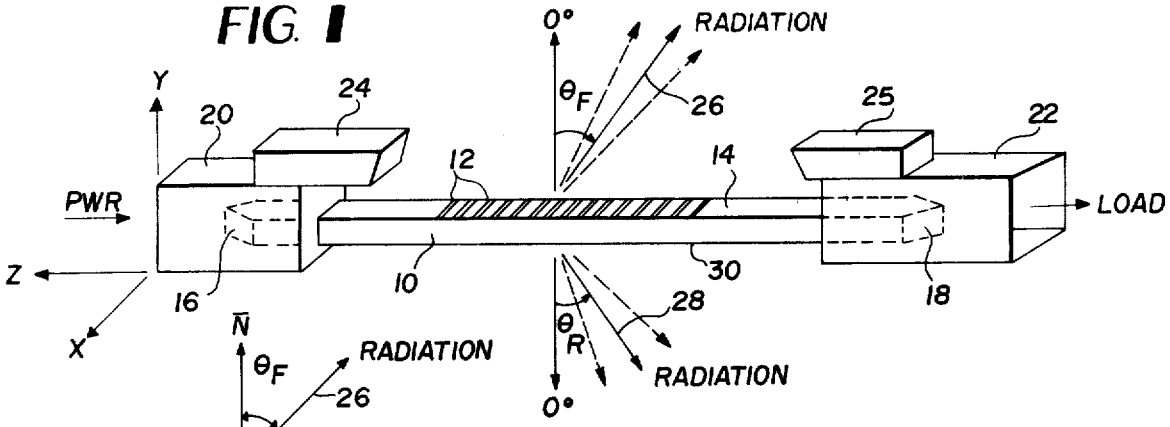
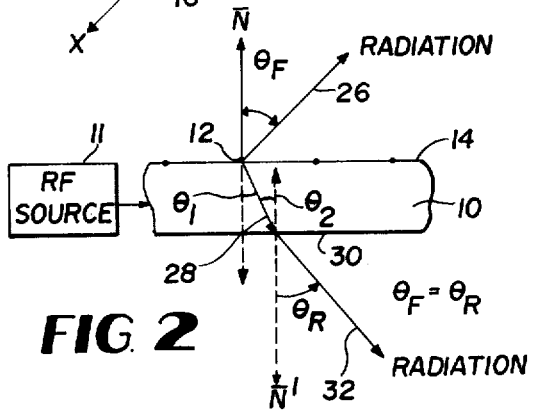
FIG. 2
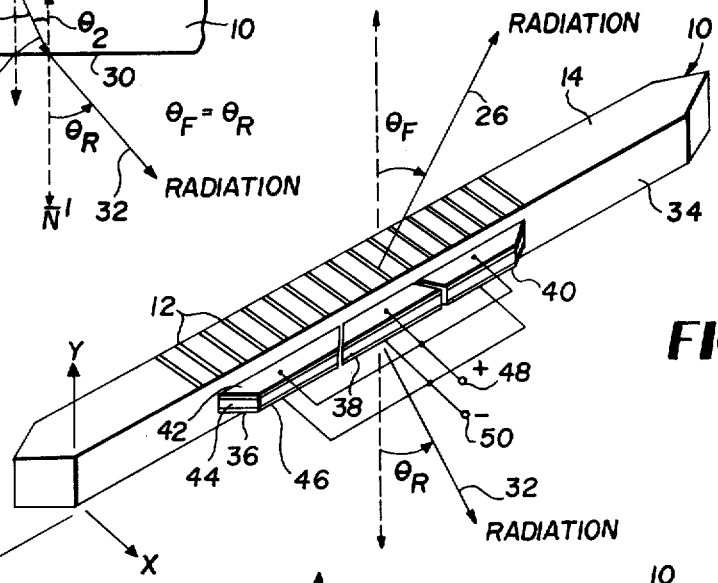
FIG. 3
FIG. 4
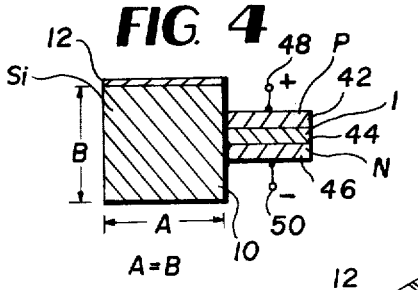
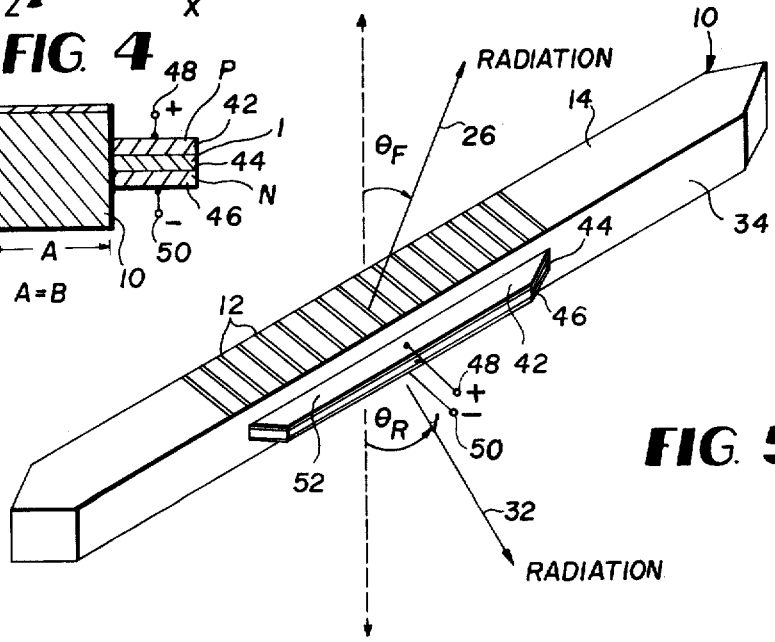
FIG. 5

RADIATION PATTERN
IN RADIAL (θ) DIRECTION

RADIATION PATTERN IN X-Y PLANE

DUAL BEAM LINE SCANNER FOR PHASED ARRAY APPLICATIONS

The invention described herein may be manufactured and used by or for the Government for governmental purposes without the payment of any royalties thereon or therefor.

BACKGROUND OF THE INVENTION

This invention relates to line scanners operating in the millimeter wave region and more particularly to a semiconductor waveguide line scanner.

In U.S. Pat. No. 3,959,794 issued to M. M. Chrepta and Harold Jacobs, one of the present inventors, there is disclosed a single element line scanner applicable to millimeter or submillimeter wave beam steering which includes a semiconductor waveguide made of a high resistivity bulk single crystal intrinsic semiconductor material such as silicon. Parallel spaced radiator elements are disposed on the top surface of the semiconductor waveguide transverse to the direction of wave propagation along the waveguide and parallel spaced PIN diodes are formed in the semiconductor material comprising the waveguide along either the opposite surface or an adjacent surface forming a conductivity sheet which is electronically modulated as a function of the bias current for the frequency to control the angle of radiation from the top surface while preventing radiation from the surface in which PIN diodes are formed. This reference is meant to be incorporated by reference, since the present invention results from an outgrowth of the teachings of U.S. Pat. No. 3,959,794.

In addition to the Chrepta patent, reference is also directed to U.S. Pat. No. 2,921,308, Hanson, et al. issued on Jan. 12, 1960, which patent constitutes a reference cited in the prosecution of the Chrepta patent, as well as U.S. Pat. No. 3,155,975, M. G. Chatelain, issued on Nov. 3, 1964, the latter patent being developed during a cursory search of the Patent Office records and constitutes an antenna composed of an elongated microstrip with a plurality of space staggered radiating elements disposed on one surface of a dielectric block including a ground plane disposed on the opposite face.

SUMMARY

Briefly, the present invention is directed to a line scanner providing dual beam line scanning with each beam coming out of opposite faces of a semiconductor waveguide at equal angles and of substantially the same shape. The waveguide has substantially equal cross sectional dimensions and includes a plurality of equally spaced metallic strips or perturbations formed on one surface of the waveguide transverse to the direction of propagation. At least on distributed PIN diode structure consisting of sandwiched layers of P-type, intrinsic and N-type silicon are formed parallel to the longitudinal axis on the surface of one adjacent side of the waveguide in the region of the metallic perturbations. Conductivity of the distributed PIN diode(s) is selectively controlled to effect a change in the operating wavelength in the waveguide causing radiation at prescribed equal angles from opposite faces of the waveguide, one of which includes the metallic perturbations. Control of the radiation angle is also accomplished by means of a frequency modulated RF signal source coupled to the waveguide.

BRIEF DESCRIPTION OF THE DRAWINGS

FIG. 1 is a perspective view generally illustrative of the subject invention;

FIG. 2 is an illustration helpful in understanding the operations of the subject invention;

FIG. 3 is a perspective view of a preferred embodiment of the subject invention;

FIG. 4 is a transverse cross sectional view of the embodiment shown in FIG. 3;

FIG. 5 is a perspective view illustrative of another preferred embodiment of the present invention;

DESCRIPTION OF THE PREFERRED EMBODIMENT

Figure 6:
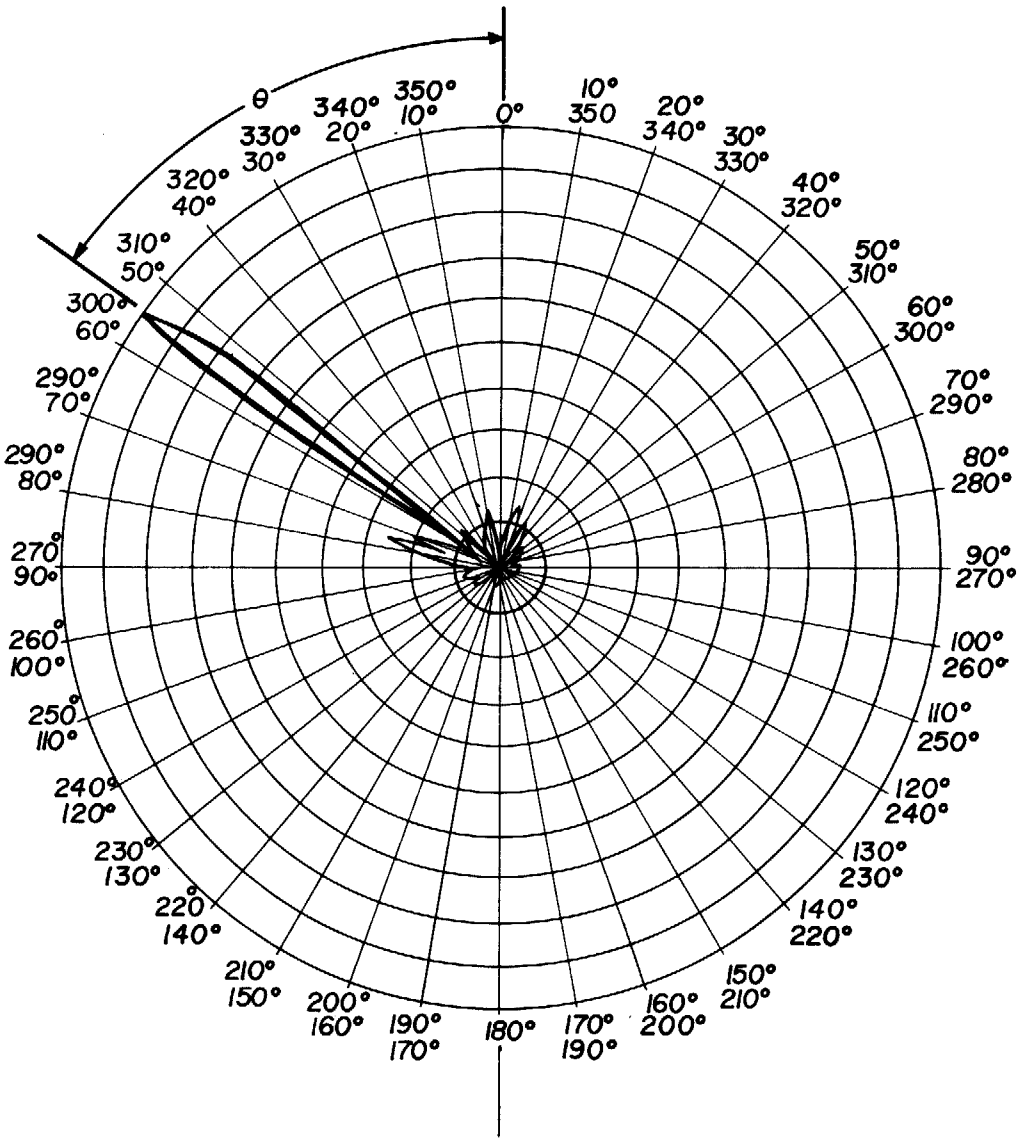
FIG. 6 is illustrative of a radiation pattern in the Y–Z plane from the present invention.

Referring now to the drawings wherein like numerals refer to like components throughout, reference is first made to FIG. 1 wherein reference numeral 10 denotes an intrinsic single crystal semiconductor waveguide element provided with a plurality of uniformly spaced parallel metallic strips or perturbations 12 preferably comprised of copper disposed on one face or surface 14 of the semiconductor waveguide 10 transverse to the longitudinal and propagation axis Z.

The semiconductor waveguide 10 is preferably comprised of silicon and is substantially square in cross section as shown in FIG. 4 wherein the dimensions a and b are substantially equal and being typically 1.0 millimeter for a 12 centimeter length of waveguide having tapered ends 16 and 18. The tapered ends terminate in input and output metal waveguides 20 and 22 which additionally include microwave energy absorber elements 24 and 25 projecting inwardly over the face 14 of the semiconductor waveguide 10 to localize radiation from the face 14 to the vicinity of the metallic perturbations 12. The drawing in FIG. 1 as well as the embodiments shown in FIGS. 3 and 5 are not drawn to scale since for operation in the 50–70 GHz operating range, the number of perturbations 12 is typically sixteen and have a width in the order of 0.6 millimeters while having a spacing of 2.0 millimeters from its nearest neighbor.

In operation, referring to FIG. 2, energy propagated along the Z axis of the waveguide 10 in the $E_{11}y$ mode interacts with the metallic perturbations 12 causing a small component of electric field in the X axis direction, so that a very small amount of current is generated therein causing radiation outwardly therefrom into air at an angle $\theta_F$ in accordance with the teachings of the aforementioned U.S. Pat. No. 3,959,794. It has been proven both mathematically and experimentally that in addition to the forward beam 26, a substantially like beam 28 emanates in the opposite direction, which leaves the bottom face 30 of the waveguide 10 as a rearward beam 32 at an angle $\theta_R$ which is equal to the forward radiation angle $\theta_F$.

Figure 7:
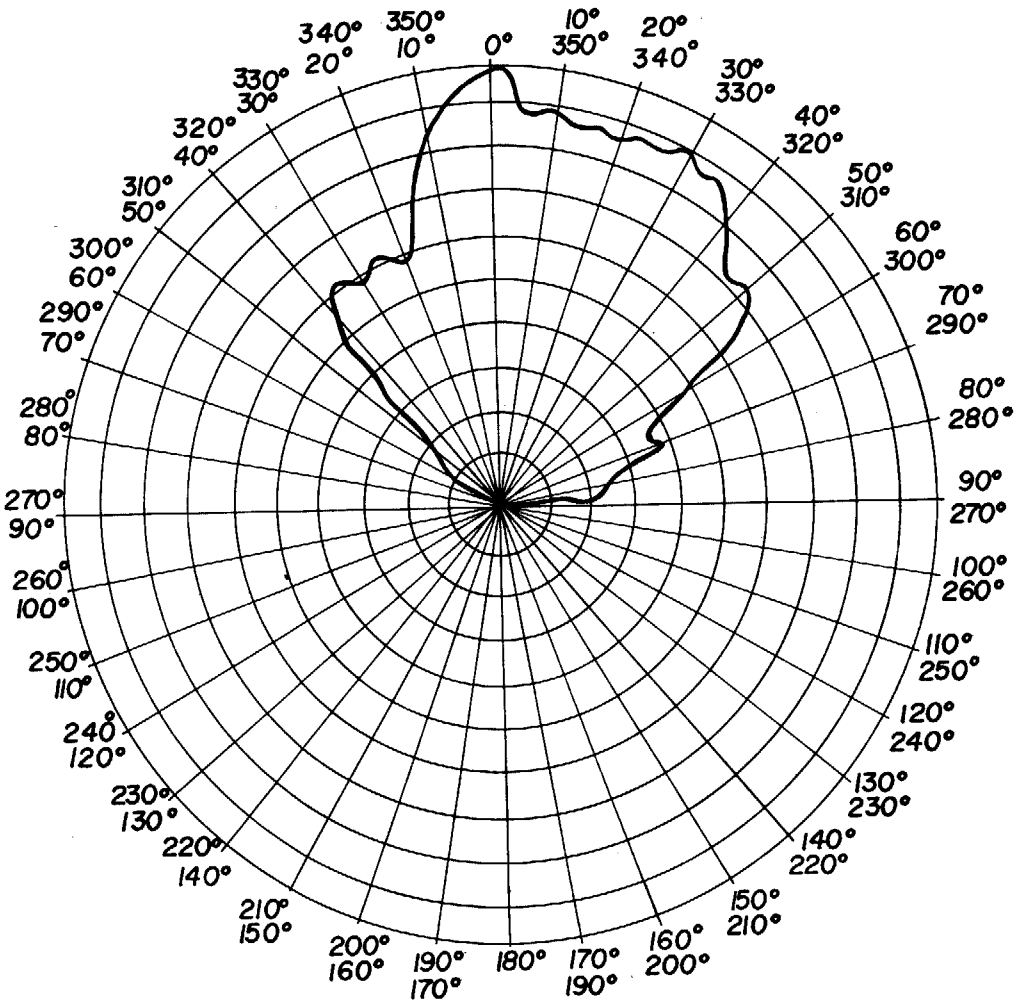
FIG. 7 is a diagram illustrative of the radiation pattern in the X–Y plane of the subject invention.

The forward and rearward beams 26 and 32 consist of substantially identical fan beams having a narrow beam width in the radial direction as shown in FIG. 6 while spreading outwardly in the X–Y plane as shown in FIG. 7.

Whereas in the referenced prior art, namely the Chrepta, et al. patent, for a constant input frequency a plurality of parallel spaced PIN diodes were formed in one of the faces of the semiconductor waveguide for varying the wave length in the silicon waveguide and thereby control the angle $\theta_F$ of the forward beam 26 as a function of the PIN diode conductivity.

Referring now to the embodiment shown in FIGS. 3 and 5 which operate to provide both forward and rearward beams 26 and 32, the control of the respective beam angles $\theta_F$ and $\theta_R$ are provided by elongated distributed PIN diode configurations extending longitudinally on as opposed to in and along the side surface 34 of the semiconductor waveguide 10. Referring now to FIG. 3, the configuration shown thereat includes three longitudinally extending distributed PIN diodes 36, 38 and 40, each consisting of respective sandwiched layers of P-type semiconductor material 42, intermediate layers of intrinsic semiconductor material 44, and layers of N-type semiconductor material 46. This sandwich configuration is moreover shown in cross section in FIG. 4. The three longitudinally distributed PIN diodes 36, 38 and 40 are axially aligned in the Z axis direction and span the total number of perturbations 12 on the upper face 14 of the waveguide 10. The average length of the diodes is substantially equal and have sloping end faces so that a relatively small separation is provided between the intermediate PIN diode 38 and the two outer diodes 36 and 40 whereby a substantially continuous PIN diode is provided. The major faces of the PIN diodes accordingly are shaped in the form of a trapezoid with the intermediate PIN diode being reversed with respect to the other two. The P-layers 42 of the three PIN diodes 36, 38 and 40 are commonly connected to a bias terminal 48 as shown in FIG. 4 while the N-layers 46 are commonly connected to a terminal 50. The terminals 48 and 50 are labeled + and − respectively, and are adapted to receive a bias potential which controls the conductivity of the three PIN diodes and accordingly modulates the wavelength of the silicon waveguide 10 which acts to vary the radiation angles $\theta_F$ and $\theta_R$ for a constant frequency of the energy delivered to the waveguide 10 along the Z axis.

The configuration shown in FIG. 5 is similar to that shown in FIG. 3 with the exception that now a single integral PIN diode 52 is longitudinally distributed on the side face 34 in place of the three PIN diodes 36, 38 and 40. The configuration of the three semiconductor layers 42, 44 and 46 is the same as shown in FIG. 4, and the diode extends the full length of the perturbations 12. The end faces of the single distributed PIN diode 52 are sloped, thereby providing a trapezoidal shape of the diode when viewed from the top or bottom. As in the other embodiment, i.e. FIG. 3, bias terminals 48 and 50 are connected to P and N layers 42 and 46, respectively which when a modulating bias voltage is applied thereto, controlled angles of radiation $\theta_F$ and $\theta_R$ will result.

Figure 8:
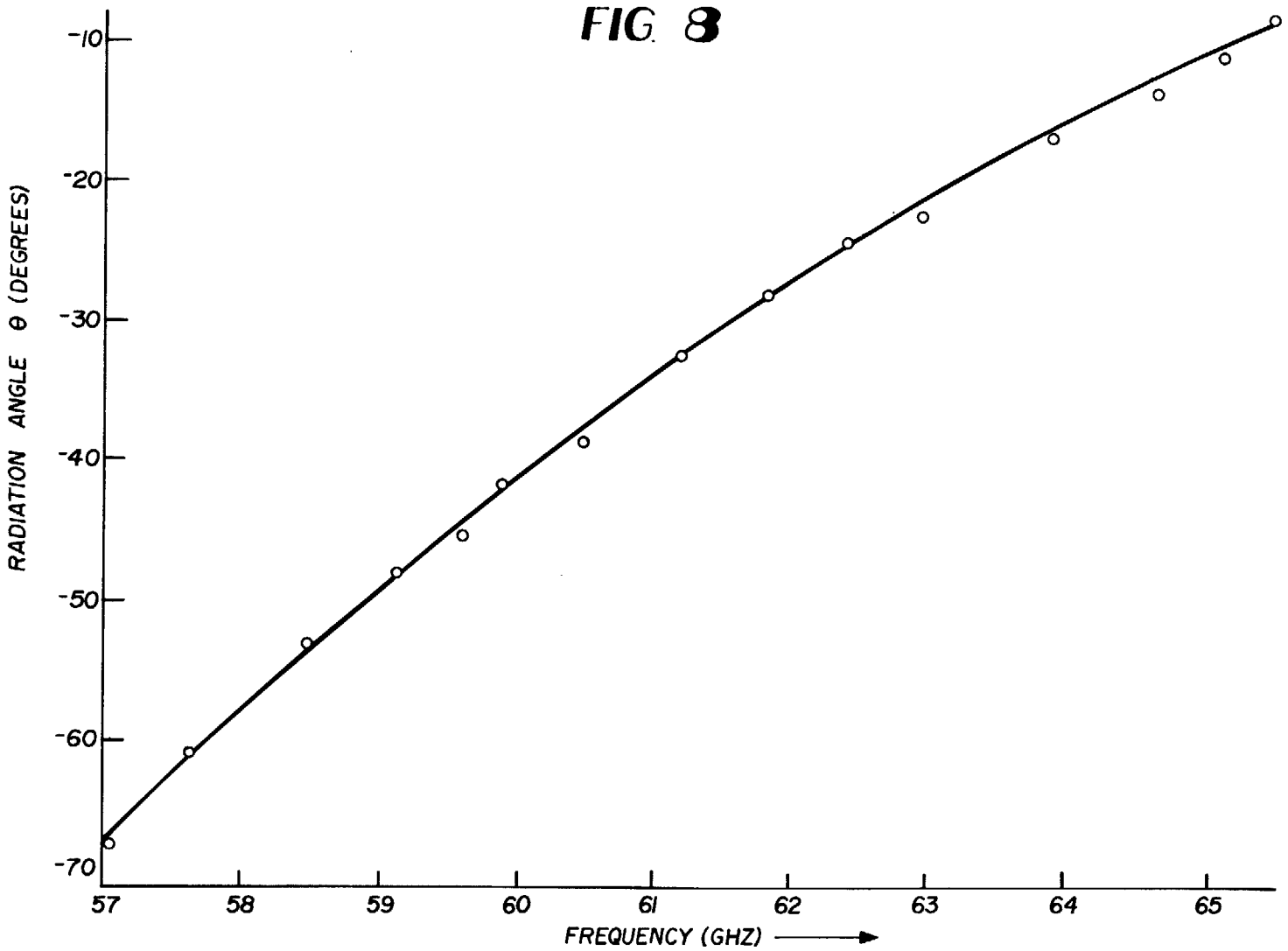
FIG. 8 is a diagram of a characteristic curve of the variation in radiation angle as a function of operating frequency.

Although the present invention has been shown and described up to this point having the constant frequency applied to the semiconductor waveguide 10, reference to FIG. 8 indicates that for a fixed pattern of metallic perturbations 12, the radiation angle $\theta$ is not constant, but varies as a function of the frequency of the energy propagated along the Z axis in the semiconductor waveguide 10. Accordingly, a variable frequency $f_i$ from the source 11, shown in FIG. 2, which, for example may be a frequency modulated RF signal source when coupled to the semiconductor waveguide 10, will control the radiation angles $\theta_F$ and $\theta_R$, operating either exclusively of or in combination with the distributed PIN diode configuration shown in FIGS. 3 and 5.

Having thus disclosed what is at present considered to be the preferred embodiments of the subject invention, it is to be understood that modifications and variations from the embodiments of the invention disclosed herein may be made without departing from the spirit and scope of the invention as defined in the appended claims.

Accordingly,

We claim as our invention:

1. A semiconductor waveguide scanning antenna providing dual beams of radiation, comprising in combination:

a length of semiconductor waveguide of rectangular cross section adapted to propagate wave energy along a longitudinal axis transverse to said cross section and having a plurality of spaced parallel metallic elements selectively located on one surface of said waveguide along its length which act as perturbations that interact with the propagated wave energy to produce a first radiation pattern directed outwardly from said one surface at a predetermined radiation angle and a second radiation pattern at substantially the same said predetermined radiation angle directed outwardly from a surface opposite said one surface;

distributed PIN diode means formed from contiguous layers of semiconductive material located on an adjacent surface of said waveguide relative to said one and said opposite surface, said layers being disposed orthogonally with respect to and projecting outwardly from said adjacent surface, so that the PIN diode lies on an adjacent surface entirely outside the rectangular cross section of the semiconductor waveguide; and means coupled to said PIN diode means for applying a bias potential thereto for controlling the conductivity of said PIN diode means which has the effect of varying the wavelength of said semiconductor waveguide and accordingly the radiation angle of said first and second radiation pattern.

2. The antenna in accordance with claim 1 wherein said distributed PIN diode means is located in the region of said plurality of spaced parallel metallic elements and extending to the extremities thereof.

3. The antenna in accordance with claim 2 wherein said rectangular cross section of said semiconductor waveguide has substantially equal dimensions.

4. The antenna in accordance with claim 3 wherein said waveguide is composed of silicon.

5. The antenna in accordance with claim 1 wherein said PIN diode means comprises layers of P and N semiconductor material separated by a layer of intrinsic semiconductor material.

6. The antenna in accordance with claim 1 wherein said PIN diode means are shaped in the form of a trapezoid including a pair of parallel edges and wherein one of said parallel edges is in contact with said adjacent surface of said waveguide.

7. The antenna in accordance with claim 6 wherein said PIN diode means comprises a single distributed PIN diode aligned along said longitudinal axis of the semiconductor waveguide.

8. The antenna in accordance with claim 6 wherein said PIN diode means comprises a plurality of trapezoidal shaped PIN diodes aligned along said longitudinal axis of the semiconductor waveguide.

9. The antenna in accordance with claim 8 wherein said plurality of trapezoidal shaped PIN diodes have substantially equal separation distances between respective adjacent diodes.

10. The antenna in accordance with claim 1 wherein said semiconductor waveguide is tapered.

11. The antenna in accordance with claim 1 wherein said plurality of spaced metallic elements are equally spaced on said one surface.

12. The antenna in accordance with claim 1 and additionally including a source of RF energy having a variable output frequency coupled to said waveguide for launching wave energy along said longitudinal axis.

13. The antenna in accordance with any one of claims 1, 2, 5, 6, 10, 11, 12, wherein said PIN diode means in the dimension extending between said one surface and said opposite surface is substantially thinner than the semiconductor waveguide.

14. A semiconductor waveguide scanning antenna, comprising in combination:

a length of semiconductor waveguide of rectangular cross section adapted to propagate wave energy along a longitudinal axis transverse to said cross section and having a plurality of spaced parallel metallic elements selectively located on one surface of said waveguide along its length which act as perturbations that interact with the propagated wave energy to produce at least a first radiation pattern directed outwardly from said one surface at a predetermined radiation angle;

distributed PIN diode means formed from contiguous layers of semiconductive material located on an adjacent surface of said waveguide which is perpendicular to said one surface, said layers being disposed orthogonally with respect to and projecting outwardly from said adjacent surface, so that the PIN diode means lies entirely outside the rectangular cross section of the semiconductor waveguide; and means coupled to said PIN diode means for applying a bias potential thereto for controlling the conductivity of said PIN diode means which has the effect of varying the wavelength of said semiconductor waveguide and accordingly the radiation angle of said first radiation pattern.

15. The antenna in accordance with claim 14, wherein said PIN diode means in the dimension perpendicular to said one surface is substantially thinner than the semiconductor waveguide.

16. The antenna in accordance with claim 15, wherein said distributed PIN diode means is located in the region of said plurality of spaced parallel metallic elements and extending to the extremities thereof.

17. The antenna in accordance with claim 15 wherein said waveguide is composed of silicon.

* * * * *